US009228416B2

(12) United States Patent
Wright

(10) Patent No.: US 9,228,416 B2
(45) Date of Patent: Jan. 5, 2016

(54) APPARATUS AND METHODS USABLE FOR CONNECTING WELL EQUIPMENT

(71) Applicant: David Wright, Humble, TX (US)

(72) Inventor: David Wright, Humble, TX (US)

( * ) Notice: Subject to any disclaimer, the term of this patent is extended or adjusted under 35 U.S.C. 154(b) by 0 days.

(21) Appl. No.: 13/694,479

(22) Filed: Dec. 5, 2012

(65) Prior Publication Data

US 2014/0151055 A1 Jun. 5, 2014

(51) Int. Cl.
*E21B 41/10* (2006.01)
*E21B 33/038* (2006.01)

(52) U.S. Cl.
CPC ..... *E21B 41/10* (2013.01); *E21B 33/038* (2013.01)

(58) Field of Classification Search
CPC ..... E21B 33/038; E21B 33/035
USPC ..... 166/338, 341, 344, 85.1, 85.5
See application file for complete search history.

(56) References Cited

U.S. PATENT DOCUMENTS 4,067,062 A * 1/1978 Baugh ..... 166/125
4,667,986 A 5/1987 Johnson et al.
4,856,594 A 8/1989 Jennings
5,634,671 A * 6/1997 Watkins ..... 285/18
6,336,508 B1 1/2002 Guinn
6,474,412 B2 * 11/2002 Hamilton et al. ..... 166/77.51
2002/0066557 A1 6/2002 Hamilton et al.
2003/0042025 A1 * 3/2003 Fenton et al. ..... 166/347
2006/0231263 A1 10/2006 Boyce et al.
2010/0139925 A1 6/2010 McKay et al.
2010/0155074 A1 6/2010 Rodriguez
2012/0006555 A1 1/2012 Fraser et al.

OTHER PUBLICATIONS

International Search Report and Written Opinion of the International Searching Authority; International Application No. PCT/US2013/073371; Date of Mailing: Apr. 18, 2014.

* cited by examiner

*Primary Examiner* — Matthew Buck
*Assistant Examiner* — Patrick Lambe

(57) ABSTRACT

Systems and methods enable connection of, and are usable to connect, well servicing equipment to other well equipment, including wellheads, blowout preventers, and other well servicing equipment. The systems comprise connecting apparatus having a male connector and female connector. The male connector comprises an elongate body having an axial bore extending therethrough and a plurality of protrusions extending from the elongate body at an angle relative to the axial bore. The female connector can be adapted for connection with the male connector, wherein engagement between the male connector and female connector communicates the axial bore of the male connector with a bore of the female connector to define a flowpath for communicating a medium. The systems and methods enable the ability to connect or disconnect well equipment remotely without the need of a diver, an ROV, and without the need to bring the well equipment to the surface for disassembly.

17 Claims, 7 Drawing Sheets

APPARATUS AND METHODS USABLE FOR CONNECTING WELL EQUIPMENT

FIELD

Embodiments usable within the scope of the present disclosure relate, generally, to systems and methods usable to securely connect well equipment and/or other servicing equipment to wellheads, blow out preventers, or other associated items of well equipment, and more specifically, systems and methods having the ability to connect or disconnect well equipment remotely, without the need of a diver or remotely operated vehicle (ROV), and without requiring an equipment stack to be retrieved to the surface for disassembly.

BACKGROUND

Typically, connection of well equipment requires mating of corresponding flanges and bolting of the flanges. Conventional methods for connecting or disconnecting well servicing equipment require the use of an ROV or a diver to bolt or unbolt the flanges. This process is time consuming and expensive, especially when performed in a subsea environment. Remotely actuated connectors can be used to eliminate manual connection operations, such as those performed by divers and ROVs, when connecting well servicing equipment to and from a wellhead or other items of well equipment, resulting in a more efficient and less expensive process.

However, conventional remotely actuated connectors are complex and typically contain locking mechanisms embedded within the connector bodies and/or covered by framing. These locking mechanisms often require the interaction of many moving parts, such as cam rings, wedge rings, dogs, springs, bolts, etc. and are susceptible to contamination and frequent failure, especially when used within a subsea environment. Performing maintenance on subsea connectors is difficult, often requiring retrieval of entire equipment stacks to the surface. A need therefore exists for well equipment connectors that are not susceptible to contamination, are easy to maintain, and provide the ability to reliably, securely, and remotely form connections for extended periods of time, and to reliably and remotely disconnect from an object when desired.

Special considerations must be taken when a connector is used in association with a riser, due to the movement imparted to a riser by waves, currents, and other subsea conditions. This movement is transmitted to the wellhead and equipment adjacent and/or connected to the wellhead, and can cause connectors to loosen, allowing fluids to breach the seals. Conventional locking mechanisms, especially those involving numerous moving parts, have an increased tendency to loosen after a lengthy period of use, especially when repeatedly placed under large bending forces. Thus, a need also exists for well equipment connectors that can withstand strong bending forces caused by riser movement for extended periods of time.

SUMMARY

Embodiments of the present invention relate, generally, to a connector apparatus and methods usable to securely and repeatedly connect and disconnect well equipment. Further embodiments of the present connector can be remotely operable. For example, the connecting apparatus and methods can be used for connecting well equipment, such as a lubricator system, to other well equipment, including a subsea wellhead, a blowout preventer, or other associated equipment, without requiring manual intervention of a diver or an ROV.

In an embodiment, a connector can include a male member having an elongate body with an axial bore extending therethrough and a plurality of protrusions extending from the body at an angle relative to the axial bore. A female member, adapted for connection with the male member, can similarly have a bore extending therethrough, and in an embodiment, can include a plurality of slots (e.g., spaces and/or orifices defined between surfaces of the female member) that can receive the protrusions of the male member. The slots can work with a retaining feature, such as a retaining pin, adapted to retain the protrusions of the male member therein, thus providing a secure engagement and using a minimum number of moving parts. For example, a hydraulic cylinder or similar actuator can be used to extend a retaining pin across one or more of the slots, such that movement of the protrusions of the male member relative to the female member is limited (e.g., via contact with the retaining pins). Once the male and female members are engaged, the bores thereof are aligned to form a conduit for communicating a medium, while the connector apparatus can be operated (e.g., remotely) to easily, quickly, and repeatedly connect and disconnect the male and female members, thereby connecting and disconnecting items of well equipment.

As such, embodiments of the present invention thereby provide connectors and methods usable to connect and disconnect items of well equipment (e.g., lubricators and subsea wellheads) securely and reliably, using a comparatively non-complex locking mechanism that can, in an embodiment, be remotely actuated.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Embodiments usable within the scope of the present disclosure relate generally to a connector apparatus and methods usable to securely and repeatedly connect a first item or stack of well equipment, for example a lubricator system, to other well equipment, such as a wellhead, a BOP, or other associated items. The disclosed embodiments further relate to systems and methods usable to remotely connect and disconnect well servicing equipment, without requiring the use of a diver or ROV, or retrieval of the well equipment to the surface for disconnection.

Figure 1B:
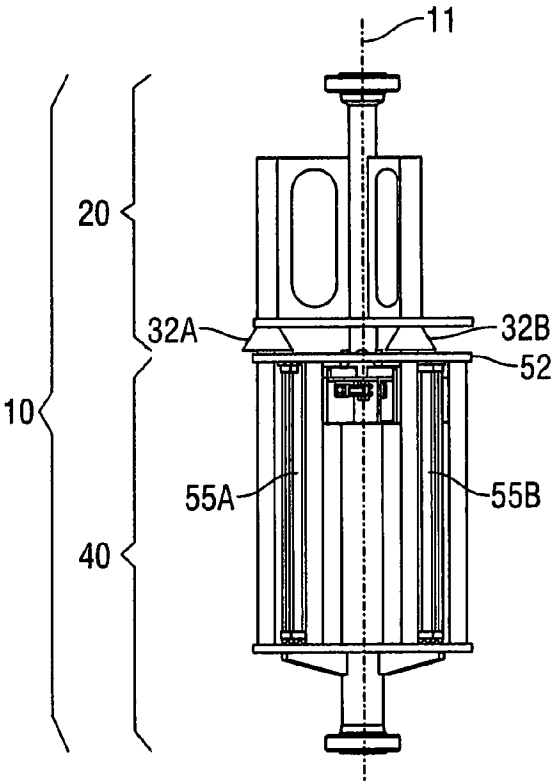
FIG. 1B depicts a side view of an embodiment of an engaged connector apparatus usable within the scope of the present disclosure.
Figure 1A:
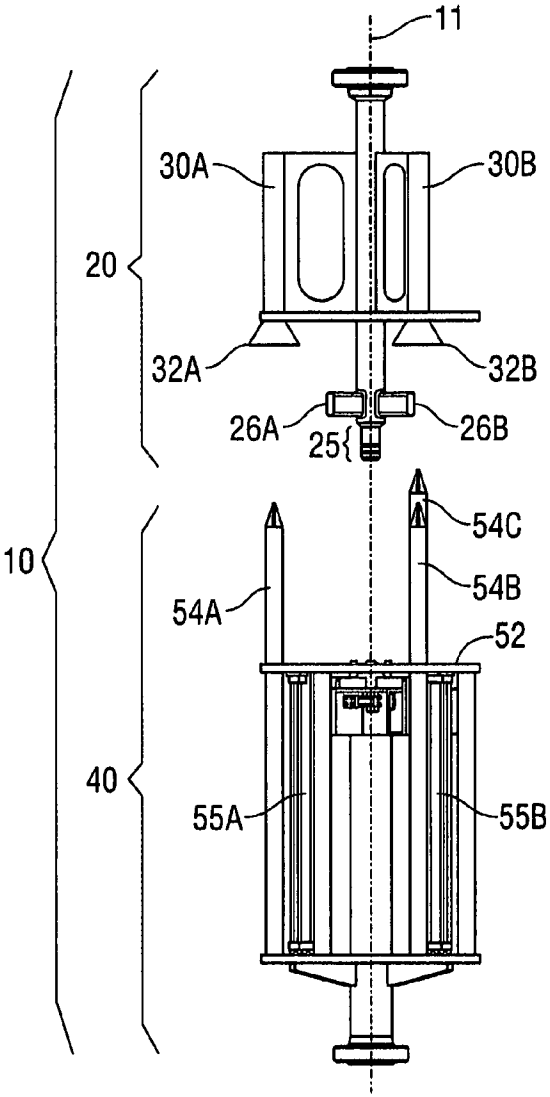
FIG. 1A depicts a side view of an embodiment of an unengaged connector apparatus usable within the scope of the present disclosure.

Referring now to FIG. 1A, a side view of an embodiment of a connector apparatus (10) usable within the scope of the present disclosure is shown. The depicted connector apparatus includes a male connector (20) and a female connector (40), each having a bore extending therethrough, such that, when the male and female connectors (20, 40) are engaged, a continuous passageway is formed for allowing a medium, such as fluid (e.g., wellbore fluids), through the connector apparatus (10), thus permitting fluid communication between two pieces of well equipment. For example, a first piece of equipment (e.g., a lubricator) could be connected to the male connector (20), while a second piece of equipment (e.g., a subsea wellhead or BOP) could be connected to the female connector (40), and the connector apparatus (10) can allow fluid communication between the well equipment when the male and female connectors (20, 40) are engaged. Specific elements of the depicted male and female connectors are shown in greater detail in FIGS. 2A through 3B, respectively, and described below. FIGS. 1A and 1B also show the axis (11) of the connector apparatus (10), retaining bars (26*a-b*), tubular members (30*a-b*), conical members (32*a-b*), and the mating region (25) of the male connector; and the guiding rods (54*a-c*), lifting cylinders (55*a-b*), and an upper plate (52) of the female connector (40), which will be discussed in more detail later in this application.

Figure 2B:
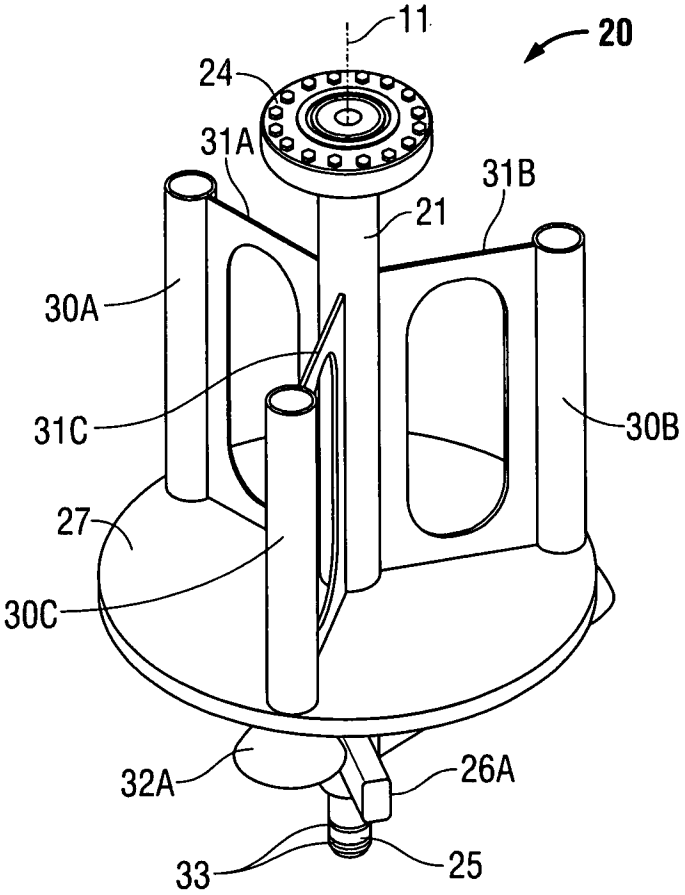
FIG. 2B depicts an isometric view of an embodiment of the male connector of the apparatus shown in FIG. 1A.
Figure 2A:
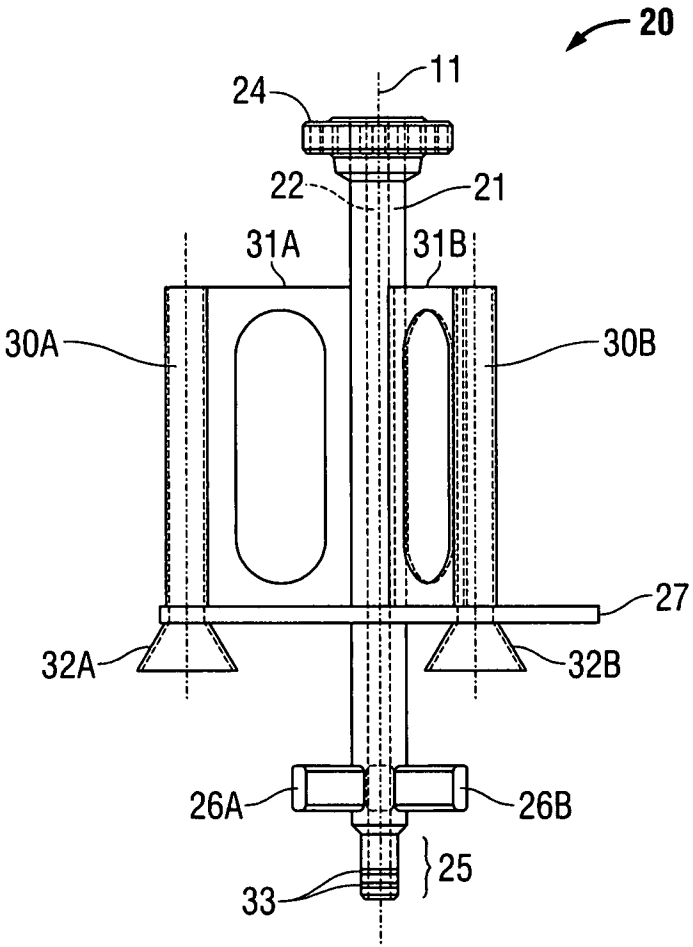
FIG. 2A depicts a diagrammatic side view of an embodiment of the male connector of the apparatus shown in FIG. 1A.
Figure 2D:
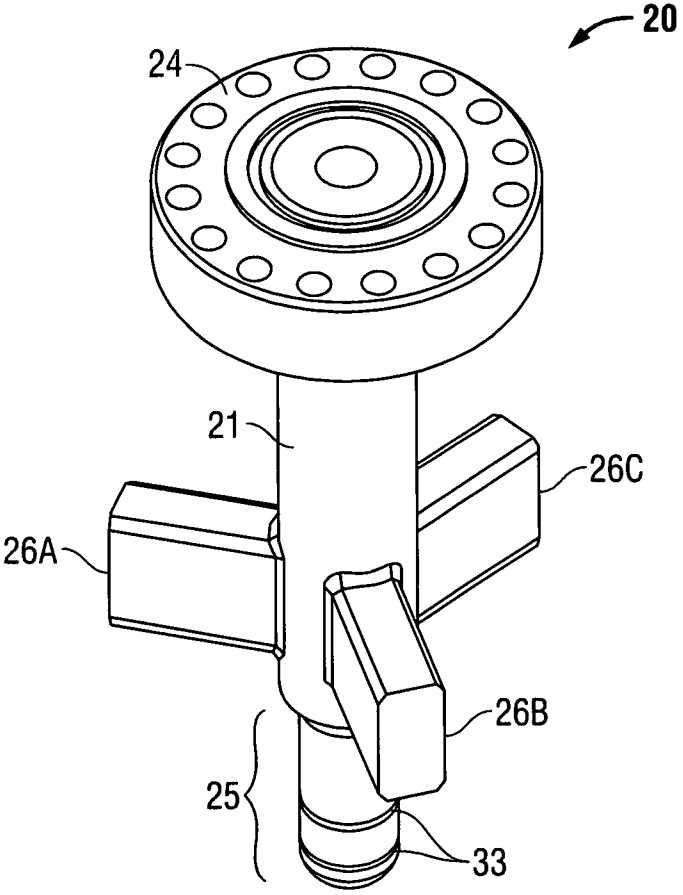
FIG. 2D depicts an isometric view of an alternate embodiment of the male connector of the apparatus shown in FIG. 1A.
Figure 2C:
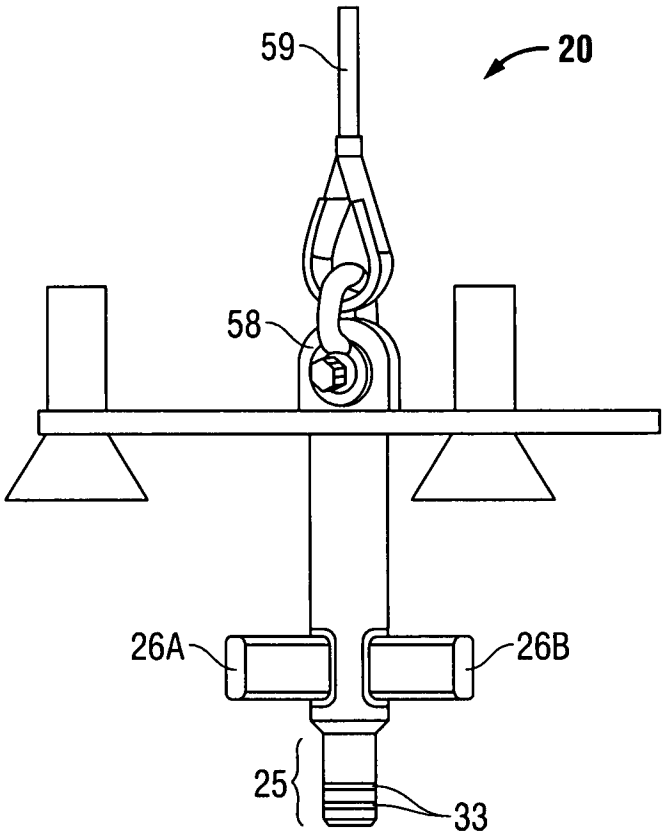
FIG. 2C depicts a side view of an alternate embodiment of the male connector of the apparatus shown in FIG. 1A.

Referring now to FIGS. 2A and 2B, a diagrammatic side view and an isometric view of an embodiment of the male connector (20), usable within the scope of the present disclosure, is shown. The male connector (20) is shown having an elongate body (21) (e.g., a tubular member) and a fluid passageway (22) (e.g., an axial bore) along the longitudinal axis (11) thereof and spanning the length of the male connector (20). A first or upper end (e.g., the upwell end) of the elongate body (21) terminates at a flange (24), which can be used to connect the male connector (20) to a lubricator or other well equipment. In other embodiments, such as depicted in FIG. 2C, the flange and/or upper end of the male connector can be replaced by an eye bolt, lifting eye (58), or other type of attachment member usable to secure the male connector to a lifting device (59) for transport thereof, as well as transport of a female connector engaged therewith.

The opposing or lower end of the male connector (20) (e.g., the downwell end) terminates at a mating region (25), shown having an outer diameter less than that of the elongate body (21). However, it should be understood that in various embodiments, the mating region could be equal in diameter, or wider, than the elongate body without departing from the scope of the present disclosure. The outer circumference of the depicted mating region (25) can be configured to include rubber o-ring seals (33) or similar sealing members to prevent fluids from breaching the connector when the mating region (25) is engaged with a corresponding sealing area (45, see FIG. 6A) of the female connector (40). It should be understood that the manner of sealing between the male and female connectors can include any type, configuration, number, and/or combination of sealing elements, including elastomeric seals, metal-to-metal seals, or other types of sealing. FIGS. 2A and 2B also depict the mating region (25) having a chamfered end, which aids insertion into the female connector (45, see FIG. 6A), e.g., through contact between the angled/chamfered surface and the female connector that guides the male connector (20) into an engaged position.

Figure 5:
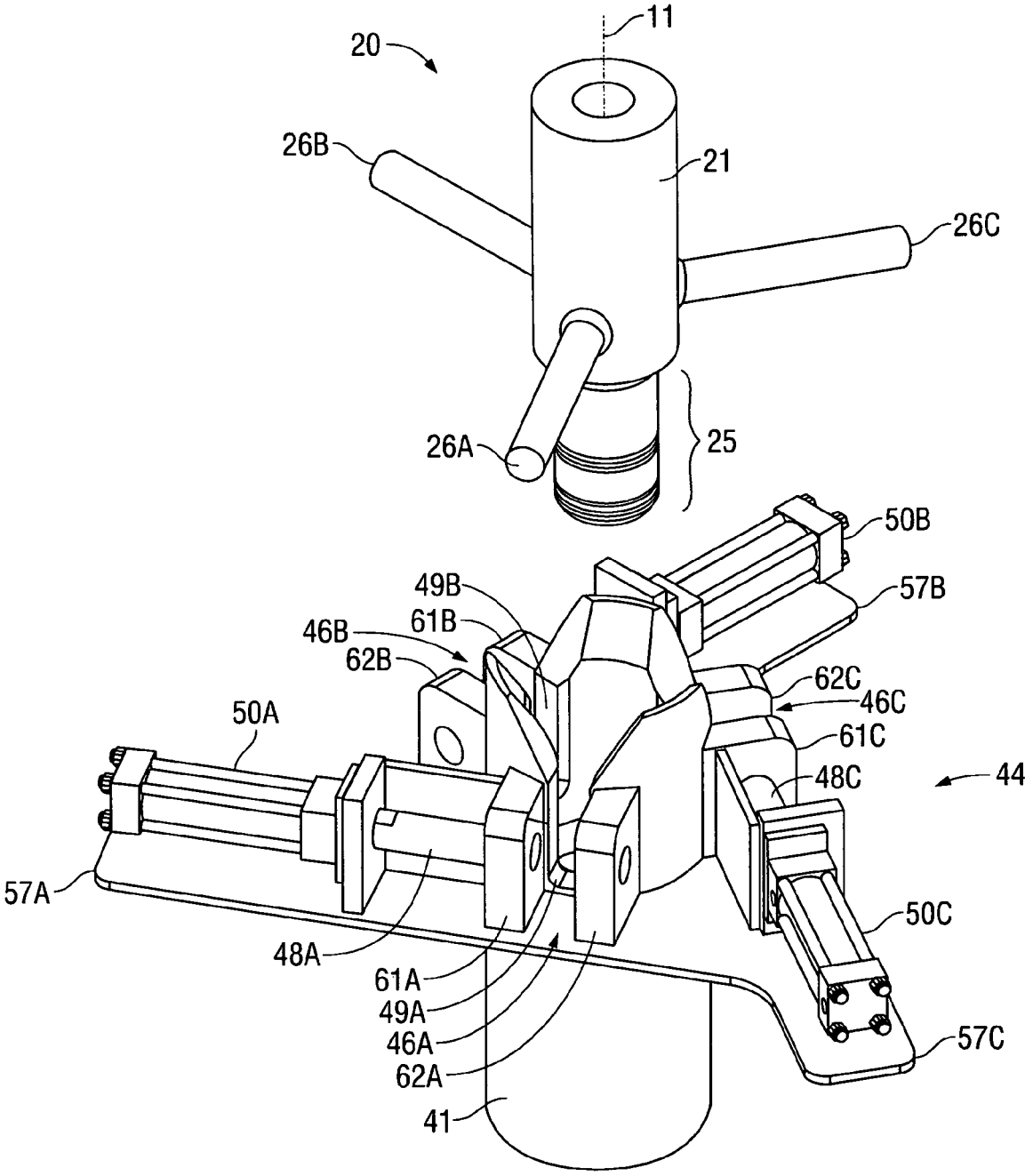
FIG. 5 depicts an isometric view of a portion of an embodiment of the male connector of FIGS. 2A and 2B and the latching system of FIGS. 4A and 4B.

Referring now to FIG. 5 for a closer view of the downwell end of the male connector (20). The downwell end of the male connector comprises three retaining bars (26*a-c*), which may be in the form of protrusions, pins, or rods, shown extending outward therefrom, proximate to the mating region (25), at an angle relative to the axis (11) thereof. For example, FIG. 5 depicts the retaining bars (26*a-c*) extending perpendicular to the axis (11) of the elongate body (21). It should be understood that while FIG. 5 depicts the retaining bars (26*a-c*) spaced generally equidistantly (e.g., 120 degrees apart) about the elongate body (21) of the male member (20), embodiments usable within the scope of the present disclosure can include any number of protrusions of any type and/or orientation. Further, while FIG. 5 depicts the retaining bars (26*a-c*) fixedly secured to and/or integrally formed with the elongate body (21), retaining bars and/or other types of protrusions can be attached to the elongate body by any available means, including welding or by using bolts. Also, the retaining bars can have any profile, shape, and/or dimensions (e.g., round, square, rectangular, etc.).

Referring again to FIGS. 2A and 2B, the male connector (20) is further shown having a framework disposed around the elongate body (21), between the retaining bars (26*a-b*, 26*c* not shown) and the flange (24). The framework can be usable to add stability and strength to the male connector (20); however, it should be understood that in an embodiment, the framework could be omitted without departing from the scope of the present disclosure. The depicted framework is shown having a generally round plate (27) with an opening at its approximate center to accommodate passage of the elongate body (21), which passes through the opening. The framework comprises three tubular members (30*a-c*) (e.g. pipes) extending from and/or through the plate (27), generally equidistantly spaced about the circumference of the plate and proximate to the perimeter thereof. The depicted embodiment includes three truncated conical members (32*a-b*, 32*c* not shown), each aligned with a respective tubular member (30*a-c*) to form a continuous body in which the truncated conical members are disposed below the plate (27), while the tubular members extend above the plate. It should be noted that in an embodiment, each truncated conical member and tubular member can be a contiguous, unitary piece, each extending through a respective orifice of the plate. The truncated conical members serve as guides, having interior angled surfaces which contact the guide members (e.g., guide rods 54*a-c*, see FIG. 3B) of the female connector during engagement, as described below. Once the guide rods (54*a-c*) are captured, the metal pipes (30*a-c*) guide the male connector (20) as it descends into the locking position with the female connector (40, see FIGS. 1A and 1B). The elongate body (21) and the tubular members (30*a-c*) are shown having spacers, e.g., vertical plates (31*a-c*) welded and/or otherwise attached therebetween. The vertical plates of the present embodiment are depicted as generally rectangular structures having an oval-shaped and/or elliptical orifice therein.

It should be understood that while FIG. 2A and 2B depict a frame embodiment having a circular plate (27), three tubular members (30*a-c*), three vertical plates (31*a-c*), and three truncated conical members (32*a-b*, 32*c* not shown), the specific orientation and number of elements can vary as described above, without departing from the scope of the present disclosure. In another embodiment depicted in FIG. 2D, all or any portion of the framework can be omitted and the overall height of the connector can be shorter. In such embodiments, the guiding action between the male (20) and the female (40) connectors may not be necessary or may be performed by means other than the framing. The structural integrity of the male connector will then be maintained by the retaining bars (26*a-c*) and the elongate body (21) of the male connector.

Figure 3B:
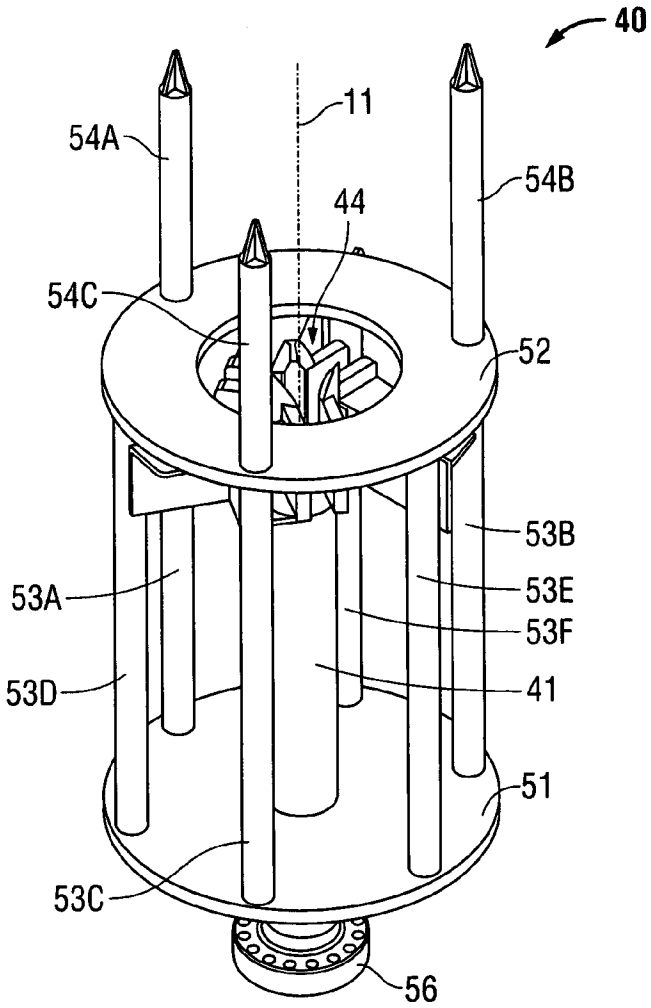
FIG. 3B depicts an isometric view of an embodiment of the female connector of the apparatus shown in FIG. 1A.
Figure 3A:
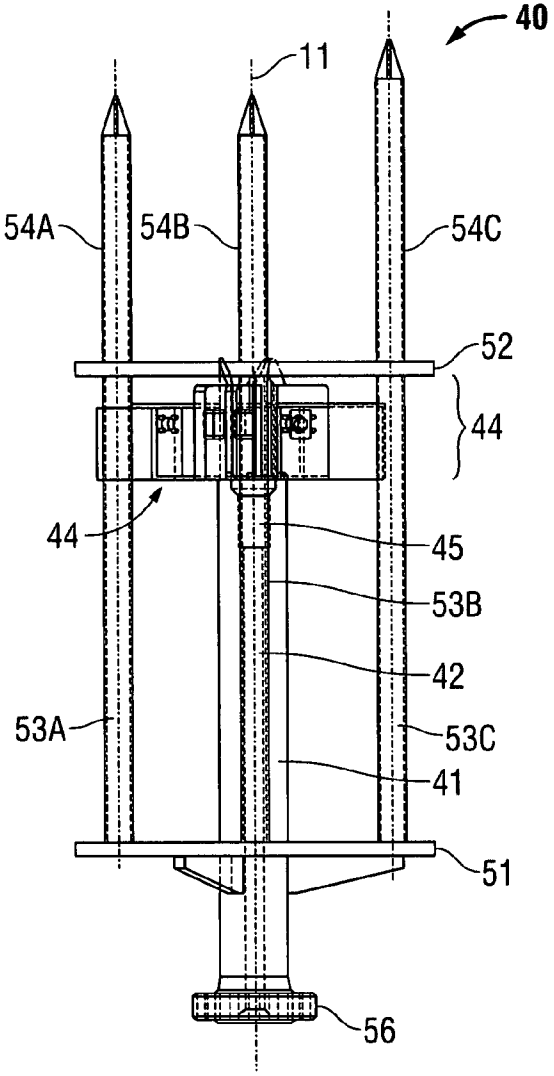
FIG. 3A depicts a diagrammatic side view of an embodiment of the female connector of the apparatus shown in FIG. 1A.

Referring now to FIGS. 3A and 3B, a diagrammatic side view and an isometric view of an embodiment of a female connector (40) usable within the scope of the present disclosure is shown. The female connector (40) is shown having an elongate body (41) and a fluid passageway (42) (e.g., a bore) extending along the longitudinal axis (11) of the connector. A first end (e.g., a downwell end) of the elongate body (41) has a flange (56) thereon and/or engaged therewith, which can be used to connect the female connector (40) to a wellhead, a BOP, or another piece of well equipment.

Figure 6A:
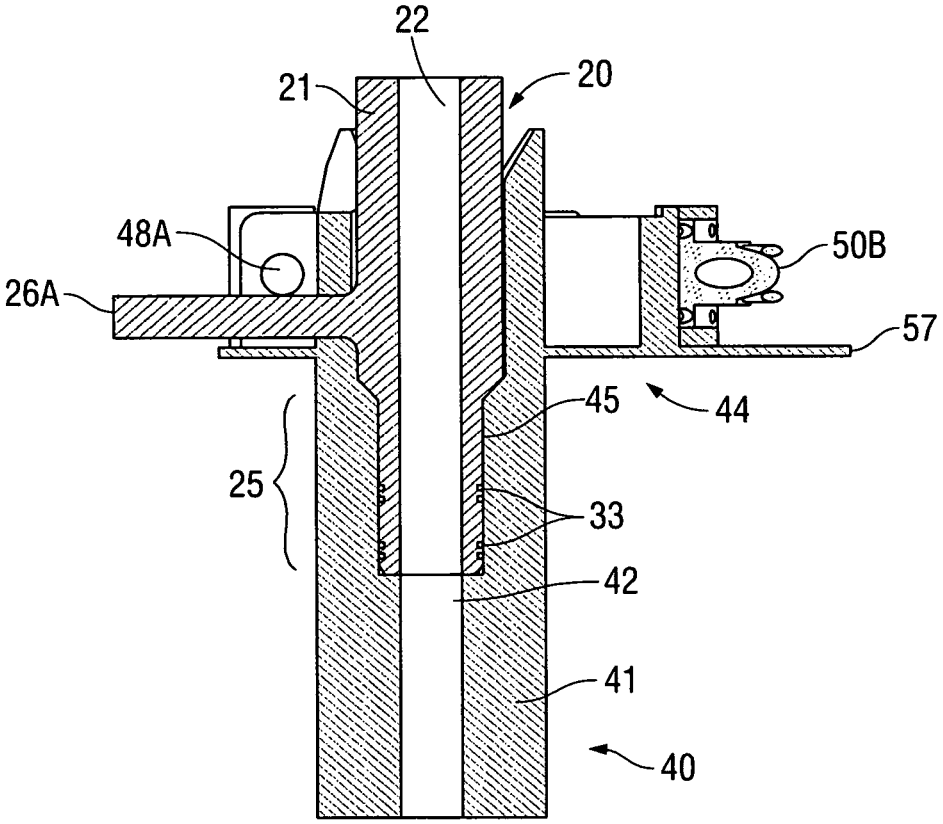
FIG. 6A depicts a diagrammatic side view of a portion of an embodiment of the male connector and the latching system of FIG. 5, in the engaged position.

The female connector (40) is further shown having a framework integrated around a latching system (44) and the elongate body (41). The framework can prevent and/or minimize the transfer of bending forces between the mating region (25) of the male connector (20) and the sealing area (45) of the female connector, as depicted in FIG. 6A, by retaining the male and female connectors oriented in a straight and/or linear relationship relative to one another. The sealing area (45) of the depicted embodiment is the inside surface area of a segment of the elongate body (41), which forms a seal with the outside surface area of the mating region (25) when the male and female connectors are engaged. Proper orientation of the mating surfaces on the mating region (25) and the sealing area (45) can prevent fluids from breaching the connector. Referring again to FIGS. 3A and 3B, the framework of the female connector (40) is shown having a lower plate (51), an upper plate (52), and a plurality of spacing members (e.g., bars) (53*a-f*) extending between the plates (51, 52). The lower plate (51) can include an opening (e.g., through the approximate center thereof) to accommodate the elongate body (41). The upper plate (52) can include an opening, e.g., through its center, to accommodate the mating region (25, see FIG. 5) and the retaining bars (26*a-c*, see FIG. 5) of the male connector, thus permitting passage of the downwell end of the male connector (20, see FIG. 5) therethrough for engagement with the female connector (40, see FIG. 5). Three of the spacing members (53*a-c*) are shown having portions that penetrate through the upper plate (52) to act as guiding rods (54*a-c*) for guiding the male connector (20) into proper alignment for engagement with the female connector (40). For example, each guide rod is shown having a generally tapered and/or conical end, which can contact the angled interior surface of a respective truncated conical member (32*a-b*, 32*c* not shown, see FIG. 2A) of the male connector (20), such that the male connector is guided into proper alignment for engagement with the female connector (40), and that the guide rods (54*a-c*) are inserted into the tubular members (30*a-c*, see FIG. 2B) as the male connector is engaged with the female connector.

It should be understood that while FIGS. 3A and 3B depict an embodiment of a female connector (40) having two generally circular plates (51, 52), six spacing members (53*a-f*) extending therebetween, and three guide rods (54*a-c*) extending above the upper plate (52), the framework can include any number and configuration of such elements, or any of the depicted elements could be omitted without departing from the scope of the present disclosure. In another embodiment, all or any portion of the framework can be omitted. In such embodiments, the guiding action between the male (20) and the female (40) connectors may not be necessary or may be performed by means other than the framing. The structural integrity of the female connector will then be maintained solely by the latching system (44) and the elongate body (41) of the female connector or by other means.

Figure 4B:
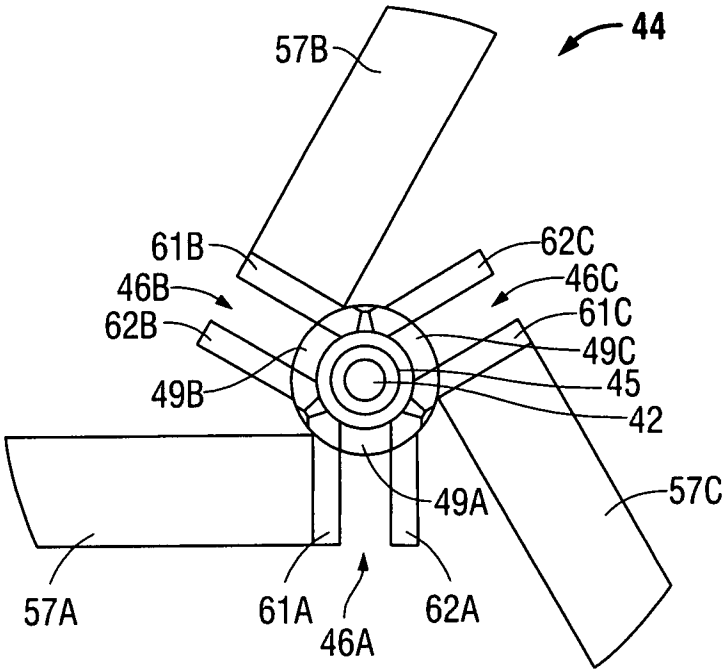
FIG. 4B depicts a top view of the latching system of the female connector shown in FIGS. 3A and 3B.
Figure 4A:
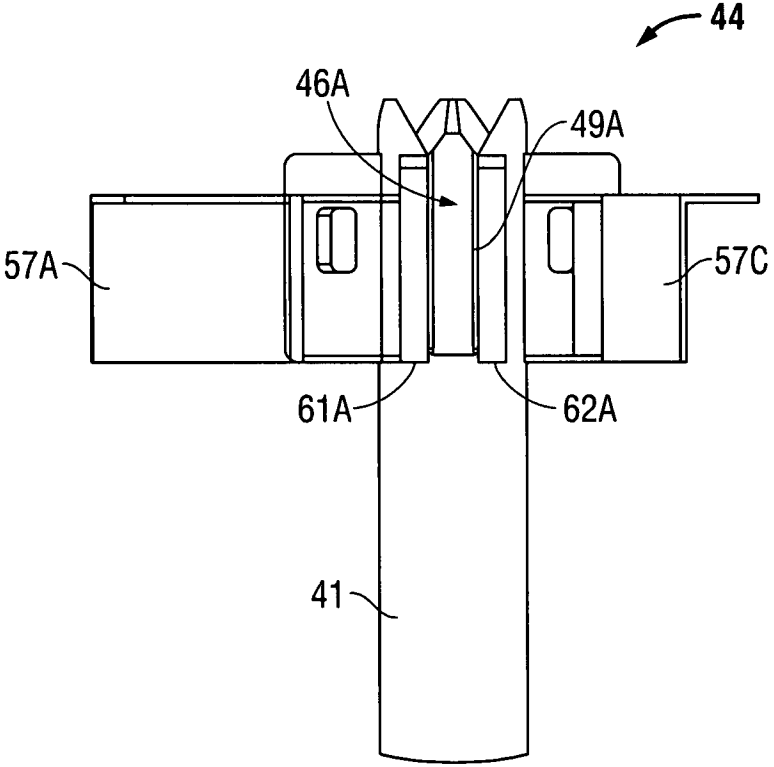
FIG. 4A depicts a side view of an embodiment of the latching system of the female connector shown in FIGS. 3A and 3B.

Referring now to FIGS. 4A, 4B, and 5, FIG. 4A depicts a side view of an embodiment of the latching system (44) of the female connector (40) and FIG. 4B depicts a top view thereof. FIG. 5 depicts an isometric view of the downwell end of the male connector (20) and an isometric view of the latching system (44), with the framework of the male and female connectors removed for clarity.

As described above, the depicted latching system (44) includes three slots (46*a-c*), which are depicted as areas of space to accommodate the protrusions (26*a-c*, see FIG. 5) extending from the male connector when the mating region (25) of the male connector is positioned within the sealing area (45, see also FIG. 6A) of the female connector. The areas that form the slots (46*a-c*) are defined by the areas of three vertical extrusions (49*a-c*) within the upwell end of the elongate body (41) of the female connector and the areas between the inner surfaces of two plates (61*a-c*, 62*a-c*) adjacent to the extrusions (49*a-c*). Each plate (61*a-c*, 62*a-c*) is shown having a throughbore, configured to allow passage of a retaining pin (48*a* and 48*c*, 48*b* not shown) therethrough. In the depicted embodiment, retaining pins can be moved between an engaged position in which the retaining pins each extend across a respective slot (46*a-c*), and a disengaged position in which the retaining pins are retracted from their respective slots (46*a-c*). Thus, when the protrusions (26*a-c*) of the male connector occupy the slots (46*a-c*) of the female connector, extension of the retaining pins (48*a* and 48*c*, 48*b* not shown) can prevent movement of the male connector relative to the female connector through contact between the retaining pins and the protrusions. The retaining pins can be moved between the engaged and disengaged positions using one or more hydraulic cylinders (50*a-c*), which are shown attached to the elongate body (41) of the female connector by brackets (57*a-c*).

It should be understood that while FIGS. 4A, 4B, and 5 depict slots (46*a-c*) defined partially by the area of the extrusions (49*a-c*), in an embodiment, the upwell end of the elongate body (41) may not contain extrusions (49*a-c*), and the slots (46*a-c*) could solely be defined by the areas between surfaces of the plates (61*a-c*, 62*a-c*). Alternatively, an embodiment of the invention may not contain plates (61*a-c*, 62*a-c*), and the slots (46*a-c*) could be defined by the extrusions (e.g. the area between the surfaces of the extrusions) in an elongate body (41). Additionally, while the depicted embodiment includes three slots (46*a-c*), generally equidistantly spaced about the perimeter of the female connector, embodiments usable within the scope of the present disclosure can include any number, shape, size, and/or configuration of slots. Furthermore, while FIG. 5 depicts retaining pins (48*a* and 48*c*, 48*b* not shown), that are moved using hydraulic cylinders (50*a-c*), in other embodiments, the retaining pins could be configured for use with other types of actuators, or for manual movement. FIG. 4B shows the fluid passageway (42) and interior sealing area (45), which will be discussed further and illustrated in FIG. 6A.

Referring now to FIG. 6A, depicting a diagrammatic side view of the latching system (44) of the female connector (40) engaged with the male connector (20). The fluid passageway (42) of the female connector is shown having an interior sealing area (45) that accommodates the mating region (25) of the male connector. It should be understood that the sealing area can be configured in any way to prevent fluids from breaching the connector when engaged with the mating region, including, but not limited to the means used to configure the sealing properties of mating region (25).

Embodiments usable within the scope of the present disclosure also relate to methods for engaging items of well equipment. Referring again to FIG. 1, a side view of an embodiment of the connector apparatus (10) is shown, in which the male connector (20), which can be attached to a first item of well equipment (e.g., a lubricator) at its upper end, is being lowered toward engagement with the female connector (40), which can be attached to a second item of well equipment (e.g., a BOP, wellhead, etc.). A ROV can be used to maneuver the male connector (20) during this process. As the male connector (20) nears the female connector (40), the ends of the guiding rods (54*a-c*), extending from the female connector (40), can contact the truncated conical members (32*a-b*, 32*c* not shown) of the male connector (20), such that the male connector (20) is oriented into alignment for proper engagement with the female connector (40). Similarly, a chamfered, angled, and/or beveled end of the mating region (25) of the male connector (20) can be guided into engagement with the sealing area (45, see FIGS. 3A and 6A) of the female connector (40) through contact with angled surfaces along the upwell end of the elongate body (41, see FIGS. 4A and 5) leading into the slots (46, see FIG. 5).

Figure 6B:
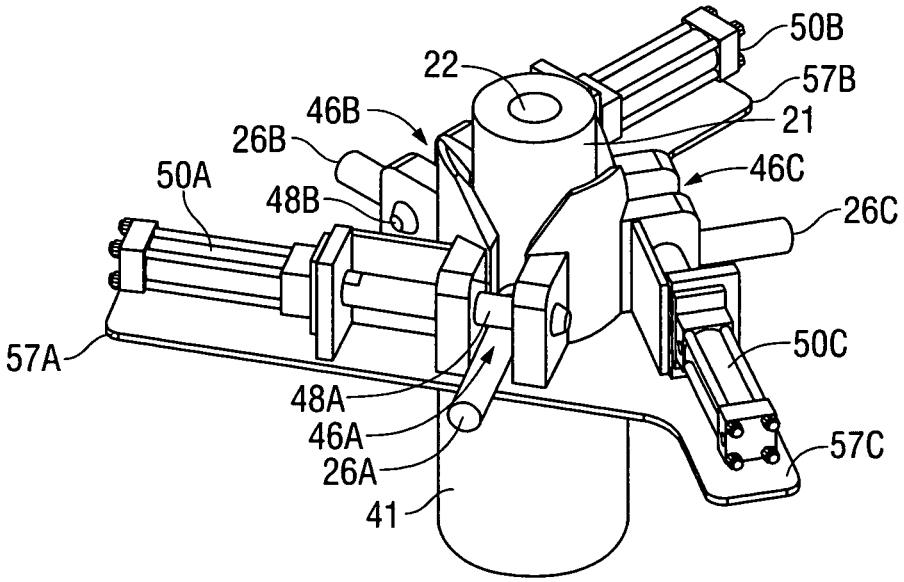
FIG. 6B depicts an isometric view of a portion of an embodiment of the male connector and the latching system of FIG. 5, in the engaged position.

Referring to FIGS. 5, 6A, and 6B, FIG. 5 depicts a close-up view of the male and female connectors (20, 40) prior to engagement, FIG. 6A shows a close-up diagrammatic side view of the male and female connectors engaged, and FIG. 6B shows an isometric close-up view of the male and female connectors engaged. FIGS. 5, 6A, and 6B are depicted without the framing of the male and female connectors for clarity purposes. Specifically, FIG. 5 depicts the mating region (25) of male connector (20) being lowered into contact with the sealing area (45) of the female connector (40). As the mating region (25) of the male connector (20) is lowered into the sealing area (45) of the female connector (40), the protrusions (26*a-c*) of the male connector (20) can contact sloped surfaces along the upwell end of the elongate body (41) leading into the slots (46*a-c*), which further align the male connector (20) for engagement with the female connector (40). The protrusions (26*a-c*) then descend into the slots (46*a-c*) as the male connector (20) is lowered.

Once the protrusions (26*a-c*) are fully inserted in the slots (46*a-c*), as the mating region (25) is fully inserted into the sealing area (45), the hydraulic cylinders (50*a-c*) can be actuated to extend the retaining pins (48*a-c*) across the slots (46*a-c*). The retaining pins (48*a-c*) move through the throughbore in first plate (61*a-c*), through the space between the plates, and into the throughbore of the second plate (62*a-c*). The protrusions (26*a-c*) are thereby locked in place, and confined in the area defined by the extrusion (49*a-c*, see FIG. 4B), the plates (61*a-c*, 62*a-c*), and the retaining pins (48*a-c*). Thus, relative movement between the male and female connectors (20, 40) is limited, while the connectors (20, 40) define a fluid passageway (22, 42), which can be sealed via o-rings (33) or similar sealing members. FIGS. 6A and 6B depict the protrusions (26*a-c*) descended into the slots (46*a-c*) and locked in by the retaining pins (48*a-b*, 48*c* not shown).

Alignment between the mating region (25) and the sealing area (45) can prevent fluids from breaching the elastomeric seals (e.g., o-rings (33) and/or a metal-to-metal or other type of seal). The protrusions (26*a-c*), which are retained in the slots (46*a-c*) by the retaining pins (48*a-c*), provide proper alignment of the male and female connectors (20, 40), and can resist bending forces introduced into the system. However, additional structural support against buckling can be provided by the frameworks of the male and female connectors (20, 40), described previously and depicted in FIGS. 2A-B and 3A-B. For example, referring to FIG. 1B, when the male connector (20) and female connector (40) are engaged, the truncated conical members (32*a-b*, 32*c* not shown) of the male connector and/or another lower surface thereof can contact the upper plate (52) of the female connector, creating additional support against lateral forces and/or relative angular movement between the two connectors, which could otherwise cause misalignment therebetween.

In the event of an emergency and/or other circumstances that cause disconnection between the connectors (20, 40) to be desirable, an emergency quick disconnect feature can be provided for quickly disengaging the male and female connectors (20, 40). To disconnect the connectors, the retaining pins (48*a-c*, FIG. 5) can be withdrawn to allow lifting of the male connector (20) from the female connector (40). As described above, and referring again to FIGS. 1A and 1B, additional hydraulics cylinders, e.g., lifting cylinders (55*a-b*, 55*c* not shown), mounted to the bottom surface of the upper plate (52), can be used to facilitate this separation. Actuation and/or extension of the lifting cylinders can push the male connector away from the female connector, separating the two components. The lifting cylinders can be configured to have stroke of sufficient length to push the male connector beyond the guiding rods (54*a-c*), such that the guiding rods are disengaged from the tubular members (30*a-b*, 30*c* not shown) and the conical members (32*a-b*, 32*c* not shown). At that point, the male connector can be moved as desired, independent of the female connector, e.g., through use of a ROV.

Referring again to FIG. 2C, a side view of an embodiment of the male connector (20) is shown, having a similar configuration as described above and depicted in FIGS. 2A and 2B, for use as a deployment tool for transporting and deploying the female connector. The upper end of the male connector (20) is shown having an eye bolt (58) or similar lifting member thereon, for engagement with a lifting mechanism (59) (e.g., a crane). To deploy the female connector at a desired location, the male connector can be engaged therewith through the process described above and depicted in FIGS. 5 and 6B—lowering the mating region (25) into the sealing area (45) such that the protrusions (26*a-c*) enter the slots (46*a-c*), then actuating the retaining pins (48*a-c*) to extend across the slots. The male and female connectors (20, 40) can then be lifted together, e.g., through use of the lifting device (59) via the eye bolt (58), to transport the female connector to a deployment location. The male connector can then be released, as described above, e.g., through retraction of the retaining pins, such that the male connector can be lifted from and/or otherwise removed from the female connector.

While various embodiments usable within the scope of the present disclosure have been described with emphasis, it should be understood that within the scope of the appended claims, the present invention can be practiced other than as specifically described herein.

What is claimed is:

1. A system for connecting well service equipment, the system comprising:

a male connector comprising:

an elongate body having first and second ends, and an axial bore extending therethrough;

a flange connecting the first end of the elongate body to a first piece of subsea equipment;

an outer sealing region on the second end of the elongate body having the axial bore extending therethrough, wherein the outer sealing region extends from the elongate body; and a plurality of protrusions between the elongate body and the outer sealing region extending at an angle relative to the axial bore; and a female connector adapted for connection with the male connector and comprising:

an elongate body having first and second ends, and an axial bore extending therethrough;

a sealing area on the first end adapted to receive therein the outer sealing region of the male connector;

a flange connecting the second end of the elongate body to a second piece of subsea equipment; and an outer surface adapted to receive the plurality of protrusions, wherein the connection additionally comprises a first frame located about the male connector and a second frame located about the female connector, wherein the first frame and the second frame each comprise a central bore through which the respective elongate bodies extend; and wherein connection between the male connector and the female connector joins the axial bore of the male connector with the axial bore of the female connector to define a flowpath for communicating a medium.

2. The system of claim 1, wherein the plurality of protrusions comprise at least three protrusions that are spaced about the elongate body having a generally equal angular distance between each adjacent protrusion of the at least three protrusions.

3. The system of claim 1, wherein each of the protrusions extends beyond the outer surface of the female connector.

4. The system of claim 3, wherein the female connector further comprises a plurality of surfaces, and wherein the plurality of surfaces are adapted to receive a protrusion of the plurality of protrusions.

5. The system of claim 3, wherein the female connector further comprises a plurality of slots, wherein each slot of the plurality of slots is defined by two or more surfaces, and wherein each slot of the plurality of slots is adapted to receive a protrusion of the plurality of protrusions.

6. The system of claim 5, further comprising a fluid actuated retaining feature adapted to retain at least one protrusion within at least one of the slots.

7. The system of claim 6, wherein the retaining feature comprises a movable member that is movable between at least two surfaces defining at least one slot, and wherein the movable member retains at least one protrusion below the movable member.

8. The system of claim 5, wherein a first surface comprises a first bore therethrough and a second surface comprises a second bore therethrough, and wherein a movable member is movable through the first bore and the second bore to retain at least one protrusion below the movable member.

9. The system of claim 1, wherein the female connector additionally comprises a plurality of hydraulic cylinders oriented parallel to the axial bore therethrough, the hydraulic cylinders engaged with the at least one plate of the first frame and the at least one plate of the second frame, and having a stroke length sufficient to clear the male connector from the female connector.

10. The system of claim 1, wherein the first frame additionally comprises a plurality of guide bores spaced equidistantly about the central bore and extending through the at least one plate, and wherein the second frame additionally comprises a plurality of guide rods spaced equidistantly about the central bore, wherein the plurality of guide rods are shaped to enter the plurality of guide bores and correspond thereto.

11. A system for connecting well servicing equipment, the system comprising:

a male connector comprising:

a male body having an axial bore extending therethrough and an outer sealing surface adjacent a first end of the male body;

a flange connecting the male body to a first piece of subsea equipment;

a plurality of rods extending from the body above the outer sealing surface;

a first frame located about the male body and comprising a central bore through which the male body extends; and a female connector comprising:

a female body having an axial bore extending therethrough, wherein engagement between the male connector and the female connector joins the axial bore of the male connector with the axial bore of the female connector to define a flowpath for communicating a medium, wherein the female body comprises an inner sealing surface adapted for receiving therein the outer sealing surface to form a fluid seal therebetween and a flange connecting the female body to a second piece of subsea equipment;

a plurality of slots, wherein each slot is adapted to receive at least one of the rods;

a fluid actuated movable member adapted to retain the at least one of the rods within the at least one of the slots; and a second frame located about the female body and comprising a central bore through which the female body extends.

12. The system of claim 11, wherein a length of the at least one of the rods is equal to or greater than a wall thickness of the female body.

13. The system of claim 11, wherein the plurality of rods are spaced about a longitudinal axis of the male body at generally equal angular distances from each other.

14. The system of claim 13, wherein each of the slots is defined by two or more surfaces, and wherein the movable member is adapted to move between the two or more surfaces to retain the at least one of the rods below the movable member.

15. The system of claim 14, wherein a first surface of the two or more surfaces comprises a first bore therethrough and a second surface of the two or more surfaces comprises a second bore therethrough, and wherein the movable member is movable through the first bore and the second bore to retain the at least one of the rods below the movable member.

16. A method for connecting well servicing equipment comprising the steps of:

connecting a female connector with a first subsea equipment, wherein the female connector has an axial bore extending therethrough, wherein the female connector comprises a plurality of slots extending radially with respect to the axial bore of the female connector, wherein the female connector comprises an inner sealing surface and a surrounding framework comprising a plurality of guide rods spaced equidistantly about the axial bore;

connecting a male connector with a second subsea equipment, wherein the male connector has an axial bore extending therethrough, wherein the male connector comprises a plurality of protrusions extending radially with respect to the axial bore of the male connector, wherein the male connector comprises an outer sealing surface and a surrounding framework comprising a plurality of guide bores spaced equidistantly about the axial bore;

moving the male connector and the female connector toward each other;

aligning the plurality of guide rods with the plurality of guide bores such that each of the respective plurality of guide rods enters one of the respective plurality of guide bores;

inserting the outer sealing surface within the inner sealing surface to form a fluid seal therebetween and to join the axial bore of the male connector with the axial bore of the female connector;

placing the plurality of protrusions within the plurality of slots; and hydraulically actuating a movable member across a slot of the plurality of slots to lock the male connector in engagement with the female connector.

17. The method of claim 16, wherein each slot of the plurality of slots is defined as a space between at least two plates, and wherein the step of placing the plurality of protrusions within the plurality of slots comprises placing the plurality of protrusions between the at least two plates.

* * * * *